US010065416B2

(12) United States Patent
Goh

(10) Patent No.: US 10,065,416 B2
(45) **Date of Patent: *Sep. 4, 2018**

(54) SEQUENCING PRINTERS

(71) Applicant: HEWLETT-PACKARD DEVELOPMENT COMPANY, L.P., Houston, TX (US)

(72) Inventor: Guan-Kwee Goh, Vancouver, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/713,948

(22) Filed: Sep. 25, 2017

(65) Prior Publication Data

US 2018/0009221 A1 Jan. 11, 2018

Related U.S. Application Data

(63) Continuation of application No. 15/301,897, filed as application No. PCT/US2014/034491 on Apr. 17, 2014, now Pat. No. 9,776,398.

(51) Int. Cl.
*B41J 2/045* (2006.01)

(52) U.S. Cl.
CPC ..... *B41J 2/04541* (2013.01); *B41J 2/04521* (2013.01); *B41J 2/04586* (2013.01)

(58) Field of Classification Search
CPC . B41J 2/04541; B41J 2/04521; B41J 2/04586
See application file for complete search history.

(56) References Cited

U.S. PATENT DOCUMENTS

| | | | | |
|---|---|---|---|---|
| 5,675,365 | A | 10/1997 | Becerra et al. | |
| 6,478,396 | B1 | 11/2002 | Schloeman et al. | |
| 6,705,691 | B2 | 3/2004 | Yamane et al. | |
| 7,128,381 | B2 | 10/2006 | Cheng et al. | |
| 9,776,398 | B2 * | 10/2017 | Goh | B41J 2/04541 |
| 2006/0227157 | A1 * | 10/2006 | Drake | B41J 2/2146 347/13 |
| 2007/0139510 | A1 | 6/2007 | Hamasaki et al. | |
| 2007/0177169 | A1 | 8/2007 | Han | |
| 2007/0247490 | A1 | 10/2007 | Sheahan et al. | |
| 2008/0001981 | A1 | 1/2008 | Hu et al. | |

(Continued)

FOREIGN PATENT DOCUMENTS

JP 2011-093227 A 5/2011

OTHER PUBLICATIONS

Chen et al., Data-conversion Controller for Inkjet Printing, SPIE Digital Library, vol. 3422, Jun. 18, 1998.

(Continued)

*Primary Examiner* — Juanita D Jackson
(74) *Attorney, Agent, or Firm* — HP Inc. Patent Department

(57) ABSTRACT

In some examples, a controller of a printbar or a printhead copies firing instructions assigned, over a first network, to a plurality of shift registers, to a plurality of parallel registers and providing, over a second network, a primitive sequence including a respective firing order of each of a plurality of primitives included in the primitive sequence to the parallel registers.

20 Claims, 5 Drawing Sheets

(56) References Cited

U.S. PATENT DOCUMENTS

| | | | |
|---|---|---|---|
| 2010/0182390 | A1 | 7/2010 | Imaizumi |
| 2013/0293623 | A1 | 11/2013 | Martin et al. |

OTHER PUBLICATIONS

Korean Intellectual Property Office, International Search Report and Written Opinion for PCT/US2014/034491 dated Dec. 26, 2014 (10 pages).

* cited by examiner

SEQUENCING PRINTERS

CROSS REFERENCE TO RELATED APPLICATIONS

This is a continuation of U.S. application Ser. No. 15/301,897, having a national entry date of Oct. 4, 2016, which is a national stage application under 35 U.S.C. § 371 of PCT/US2014/034491, filed Apr. 17, 2014, which are both hereby incorporated by reference in their entirety.

BACKGROUND

Printers are widely used and may include a printhead enabling formation of text or images on a print medium. Such a printhead may be included in an inkjet pen or printbar that includes channels that carry fluid. For instance, fluid may be distributed from a fluid supply to the channels through passages in a structure that supports the printhead(s) on the inkjet pen or printbar.

DETAILED DESCRIPTION

Figure 1:
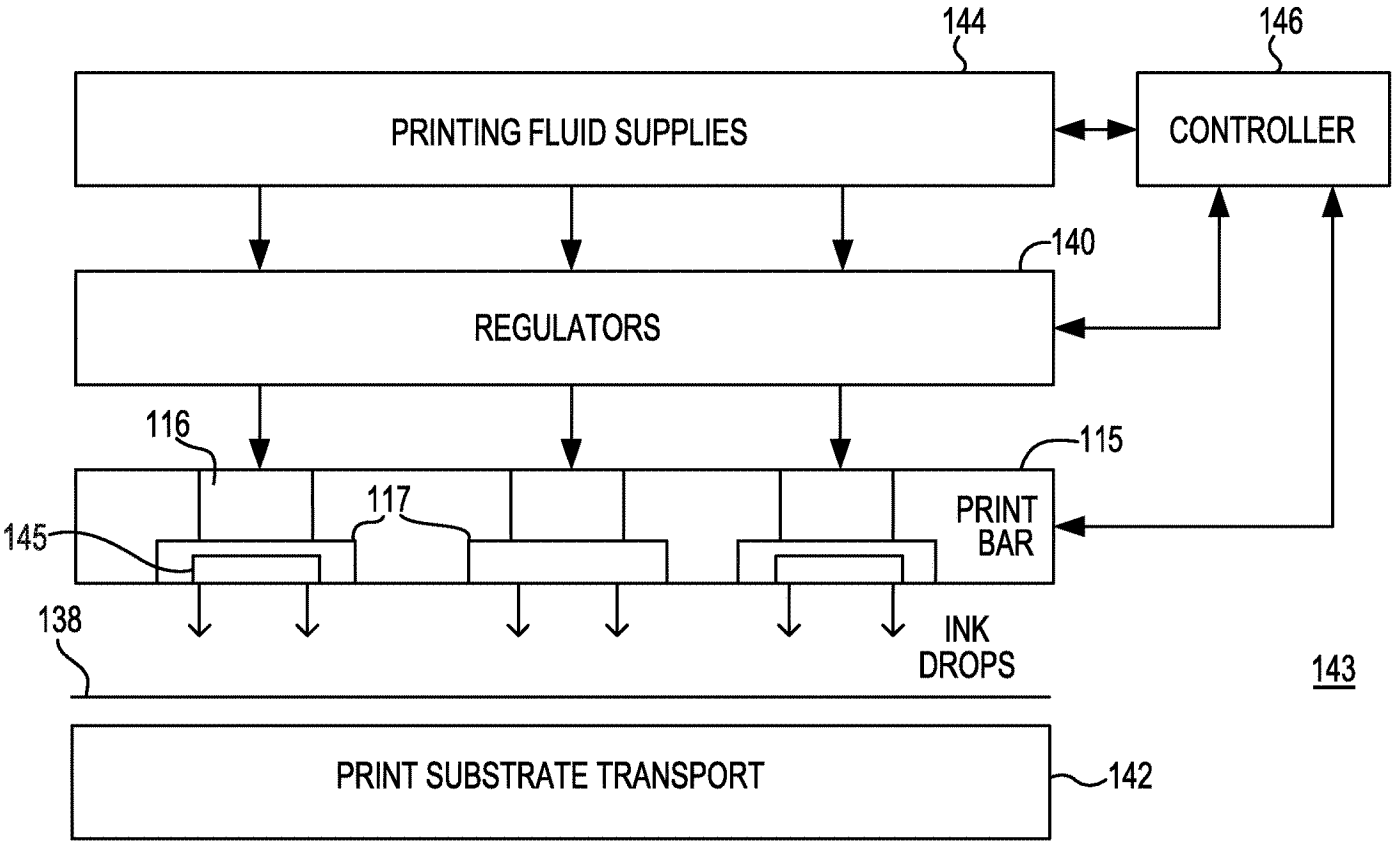
FIG. 1 is a block diagram illustrating an example of a printer for sequencing printers according to the present disclosure.

A printer may be an inkjet-printing device that ejects fluid onto a print substrate, such as paper, to form images, which can include text, on the print substrate. The printer (e.g., a piezoelectric inkjet printhead) includes a plurality of nozzles, such as those described herein, and corresponding controller. Printers that utilize a printbar assembly (e.g., a substrate wide printbar assembly) have been developed to help increase printing speeds and reduce printing costs. Printbar assemblies tend to include multiple parts that carry printing fluid from the printing fluid supplies to printheads (e.g., printhead dies) from which the printing fluid may be ejected on to paper or other print substrate and/or circuitry that provide data and/or power to the printhead.

It may be desirable to shrink the size of a printhead and/or provide a greater total number of nozzles on the printhead and/or printbar. However, decreasing the size of a printhead can involve changes to structures that support the printhead, including passages that distribute fluid to the printhead and/or circuitry that provides data and/or power to the printhead that can actually increase an overall cost associated with a printhead (e.g., due to complex fabrication processes, etc.) and/or reduce performance of the printhead.

Moreover, having a greater total number of nozzles (e.g., 10,000 nozzles) per printer (e.g., per printbar) may, with some approaches, coincide with a difficulty and/or inability to provide a desired performance. For example, it may be desirable to maintain a printing frequency above a threshold printing frequency (e.g., 200 millihertz). However, maintaining such a printing frequency may not be possible with some approaches due to various shortcomings associated therewith, such as using a single network to deliver a single sequence of print data (e.g., firing instructions) to each of a plurality of nozzles of a printer. For example, firing instructions, may be sent to each nozzle of the plurality of nozzles (e.g., sent to every pixel row concurrently) as a single sequence for a given firing sequence (e.g., before printing a page of a print job) via a single network. Such an approach may employ a large amount of circuitry and/or have difficulty and/or an inability (e.g., a timing closure associated with a total number nozzles that does not satisfy a desired level of performance) to meet a desired printing frequency due to sending print data to each of the nozzles as a single sequence via a single network.

In contrast, examples of the present disclosure include methods, systems, controllers, and computer-readable and executable instructions for sequencing printers. Sequencing printers refers to providing a portion of print data (e.g., an address sequence and/or a primitive sequence) to circuitry (e.g., shift registers and/or parallel registers) of a printer via respective networks for respective portions of the print data. A network refers to wires and/or logic gates among other circuitry suitable for providing a portion of the print data to circuitry of a printer. For example, sequencing printers can include assigning firing instructions included in an address sequence, via a first network, to shift registers of a printer and/or providing, via a second network, a primitive sequence including a respective firing order of each of a plurality of primitives to the parallel registers. Advantageously, sequencing printers can reduce an amount of circuitry associated with a printer and/or improve timing closure of a printer, among other advantages, compared to other approaches that provide print data to a printer via a single network and/or as a single sequence.

FIG. 1 is a block diagram illustrating an example of a printer for sequencing printers according to the present disclosure. Referring to FIG. 1, a printer 143 (e.g., an inkjet printer) includes a printbar 115 that can span the width of a print substrate 138, flow regulators 140 associated with the printbar 115, a substrate transport mechanism 142, ink or other printing fluid supplies 144, and a controller 146.

The printbar 115 includes an arrangement of printheads 117 to dispense printing fluid on to a sheet or continuous web of paper or other print substrate 138. As described in detail below, each printhead 117 includes a plurality of nozzles 145 arranged in a primitive(s). While FIG. 1 illustrates a page wide printbar 115 including three printheads 117 the present disclosure is not so limited. That is, the printbar 115 can span an area greater than or less a print substrate and/or include fewer (e.g., one) or more than the three printheads illustrated in FIG. 1 to promote sequencing printers. The printbar 115 can be designed to connect with other portions of the printer 143 through electrical interconnects (not shown), etc. that provide power and/or data to the arrangement of printheads 117.

The printheads 117 can be formed of semiconductor material (e.g., silicon) and can include integrated circuitry (e.g., transistors, resistors, etc.). Each printhead 117 includes fluid feed holes, thin-film layer (including firing chambers), and conductors. A slot feeds printing fluid directly to the printhead (e.g., printhead die(s)), such as to fluid feed hole(s) included in the printhead 117. The fluid feed holes provide printing fluid (e.g., ink) to fluid ejectors formed in the thin-film layer. Each printhead 117 includes an ejection chamber and a corresponding orifice through which printing fluid is ejected from the ejection chamber.

Each printhead 117 receives printing fluid through a flow path from the printing fluid supplies 144 into and through the flow regulators 140 and slot(s) 116 in printbar 115 to fluid feed hole(s) (not shown) included in the printhead 117. The printing fluid can be ejected from a plurality of nozzles 145 arranged in a primitive(s) included in a printhead 117.

The plurality of nozzles 145 can be arranged in sets (e.g., parallel sets) of nozzles (e.g., columns of nozzles) in a primitive, for example. The plurality of nozzles 145, for example, can be arranged into four respective sets of nozzles. Each set of nozzles can correspond to a particular color of fluid (e.g., black ink). For example, the four sets described above can correspond to black, cyan, yellow, and magenta colored fluids, respectively. Other arrangements including providing more or less colors of fluid to more or less sets of nozzles are possible. The plurality of nozzles 145 can be arranged in multiple columns and/or no columns, staggered or not staggered depending on a design of the nozzles. More specifically, examples are not limited to column, parallel columns, etc. For example, a single color (e.g., a black fluid) can be provided to each of the nozzles. A printhead 117 can include a suitable number of primitive(s), set(s) of nozzles, and/or be provided suitable color(s) of fluid, among other features to promote.

The plurality of nozzles 145 can each be associated with a firing chamber (not shown). The plurality of nozzles 145 can be arranged in a particular order and/or can be fired in a particular order.

The plurality of nozzles 145 can each be designated by an address. A set of addresses can make up a primitive, such as those describe herein. For example, a primitive can include 32 addresses that each designates a nozzle location. A printhead can include a suitable number of primitives to promote sequencing printers. The plurality of nozzles (e.g., those in a pen column) can be organized as a plurality of timeslots by a plurality of primitives, from a nozzle sequencing point of view. In other words, the nozzle sequencing of the plurality of nozzles can be described with an address sequence table and/or primitive sequence table.

A controller 146 can control various operations of the printer 143. The controller 146 can be analogous to controller 246 described with respect to FIG. 2 and FIG. 3.

Figure 2:
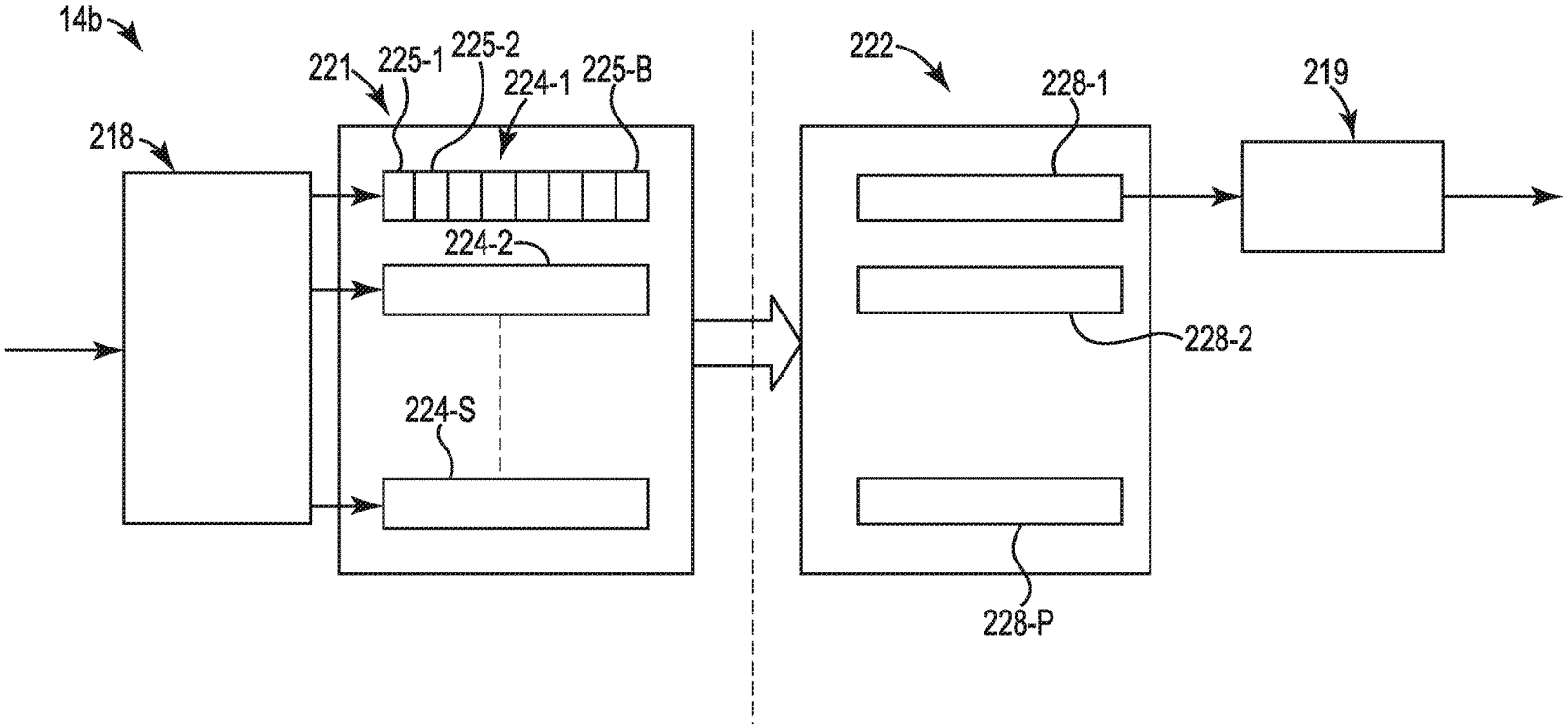
FIG. 2 is a block diagram illustrating an example of a printer implementing an example of a controller for sequencing printers according to the present disclosure.

FIG. 2 is a block diagram illustrating an example of a printer implementing an example of a controller for sequencing printers according to the present disclosure. The controller 246 represents programming, processor(s) and associated memories, electronic circuitry, and/or other components to control operative elements (e.g., a printhead 117 as described with respect to FIG. 1) of a printer.

The controller 246 may be implemented on a circuit layer of a printhead, among other possible locations. As a particular example, the controller may reside as part of a complementary metal-oxide semiconductor (CMOS) layer of the printhead. Each controller 246 (e.g., a drive circuit included in a controller) can correspond to a single nozzle of the plurality of nozzles, although each nozzle of the plurality of nozzles may have more than controller. The controller can produce an ejection waveform(s) that can be applied globally (e.g., a golden waveform) or to individual nozzles, for example, though use of a voltage scale memory (not shown), a voltage scale (not shown), an arbitrary waveform generator (AWG) (not shown), an amplifier (not shown), a lookup table (not shown), a digital to analogue converter (DAC) (not shown), and/or a protective ground (PGND) (not shown), among other possible components to promote sequencing printers. An ejection waveform can be sent to a nozzle to cause a nozzle to fire. The ejection waveform can be based upon a firing instruction. For instance, the ejection waveform(s) can be sent to a plurality of nozzle(s) in a particular firing order, such as those described herein.

The controller 246 can be defined by or include a processor resource to operate in accordance with a machine-readable program code, an application-specific circuit (ASIC), a state machine, shift registers and/or parallel registers, as described herein, and so on. Other constituency can also be used. Print controller 246 thus includes circuitry of the present teachings directed to sequencing printers. For example, the controller 246 includes circuitry, having one or more resources in accordance with the present teachings such as a plurality of shift registers 221 including shift registers 224-1, 224-2, . . . , 224-S and/or a plurality of parallel registers 222 including parallel registers 228-1, 228-2, . . . , 228-P, among other circuitry. While three shift registers 224-1, . . . , 224-S and three parallel registers 228-1, . . . , 228-P are illustrated in FIG. 2, the present disclosure is not so limited. For example, the a total number of shift registers 224-1, . . . , 224-S and/or a total number of the parallel registers 228-1, . . . , 228-P can be a suitable number of shift registers and/or a parallel registers to promote sequencing printers.

In some examples, each of the shift registers 224-1, . . . , 224-S and/or parallel registers 228-1, . . . , 228-P can include a cascade of flip-flop circuits with two stable states sharing a common time clock. Each flip-flop circuit can be connected to the data input of the next flip-flop in the cascade, resulting in a circuit that shifts a stored bit array by shifting in the data received at its input and shifting out the last bit in the array at each transition of a clock input. However, the present disclosure is not so limited. That is the shift registers 224-1, . . . , 224-S and/or parallel registers 228-1, . . . , 228-P can be any type of register and/or can input/output data in any order suitable to promote sequencing printers. For example, each of the shift registers 224-1, . . . , 224-S and/or parallel registers 228-1, . . . , 228-P can be a serial-in parallel-out register, among other types of registers. The shift registers 224-1, . . . , 224-S and/or parallel registers 228-1, . . . , 228-P can have a plurality of primitives included in a primitive sequence (not shown) associated therewith, as described with respect to FIG. 3.

Each flip-flop circuit of a shift register can be referred to as a timeslot. For example, shift register can include timeslots 225-1, timeslot 225-2, . . . , 225-B, as depicted in FIG. 2 with respect to shift register 224-1 where the last timeslot corresponds to timeslot 225-B. However, the shift registers 224-1, . . . , 224-S and/or parallel registers 228-1, . . . , 228-P can include more or less timeslots.

The shift registers 224-1, . . . , 224-S and/or parallel registers 228-1, . . . , 228-P can accept a number of input signals (e.g., data signals corresponding to firing instructions, etc.) via any number of input lines (not shown) coupled to a first network 218 and/or a second network 219. The first network 218 and the second network 219 are separate and distinct (e.g., not included as part of each other). That is, the shift registers 224-1, . . . , 224-S and/or parallel registers 228-1, . . . , 228-P can be coupled to a first network 218 and a second network 219, respectively. In this manner, an amount of data sent to shift registers 224-1, . . . , 224-S and/or parallel registers 228-1, . . . , 228-P via a respective network can coincide with a comparatively smaller total amount of data to print a particular print job compared to other approaches that may send print data (e.g., firing instructions) to each of the nozzles as a single sequence via a single network.

Such a reduction in data sent to the printhead can enable a comparatively smaller amount of circuitry to be associated with the printhead, among other benefits. For instance, a first network (e.g., an 8 to 12 network) includes a respective amount of area (e.g., physical space) and the second network (e.g., a 128 to 8 network) includes a respective amount of area that does not include the area included in the first network. Advantageously, a sum area (e.g., 24 kilogates) of an amount of area of the first network and an amount of area of the second network is comparatively smaller than an amount of area (e.g., 74 kilogates) of a corresponding single network (e.g., area of an 8 to 1536 network) due to sending respective portions of print date (e.g., address sequences and/or primitive sequences) via respective networks. Such a reduction in area associated with circuitry can again promote smaller printheads and/or printers, among other advantages.

Figure 3:
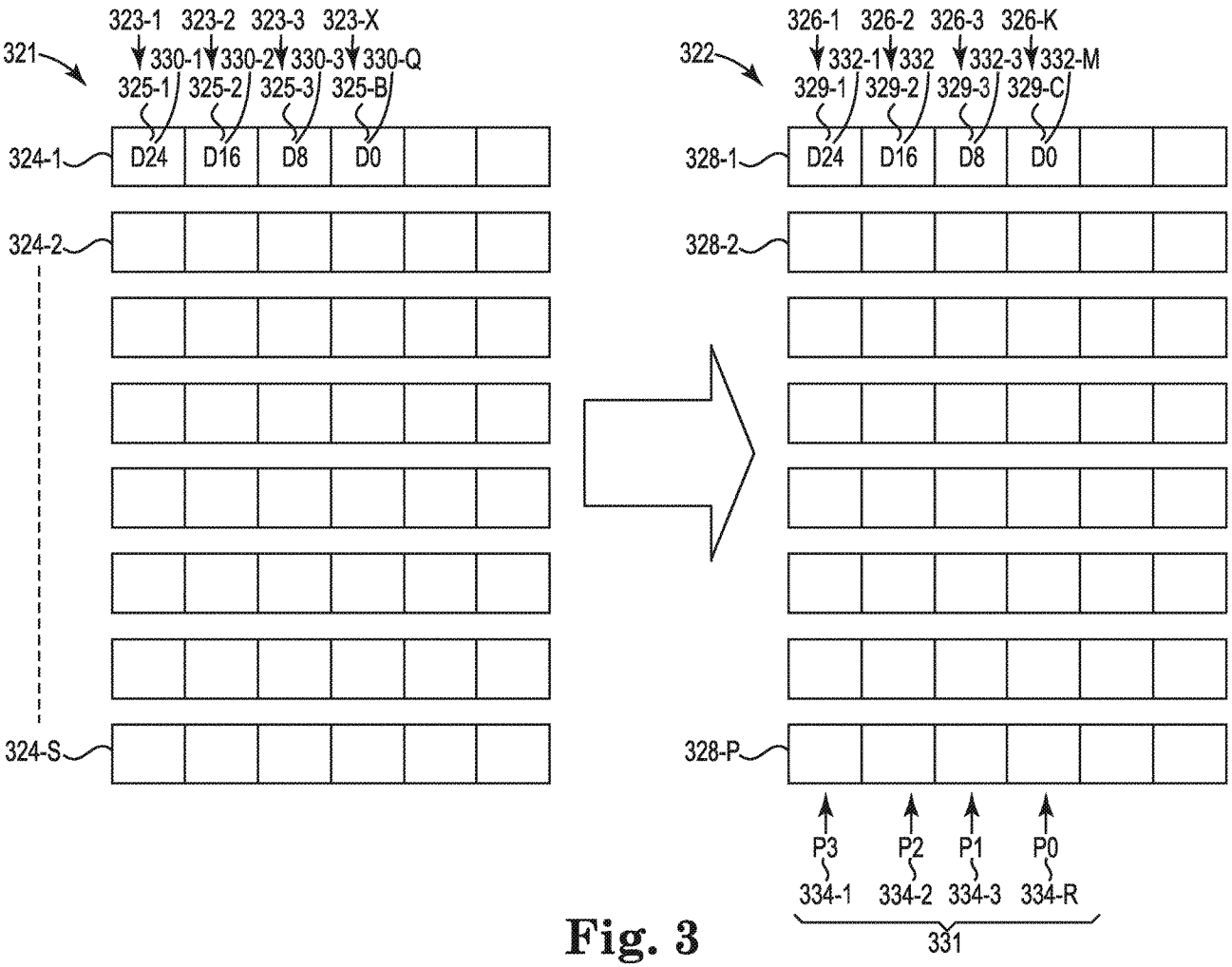
FIG. 3 is a block diagram illustrating an example of a printer implementing an example of a portion of a controller for sequencing printers according to the present disclosure.

FIG. 3 is a block diagram illustrating an example of a printer implementing an example of a portion of a controller for sequencing printers according to the present disclosure. A controller, as described herein, can include a plurality of shift registers 321 including shift registers 324-1, 324-2, . . . , 324-S and/or a plurality of parallel registers 322 including parallel registers 328-1, 328-2, . . . , 328-P. In some examples, a total number of the shift registers is equal to a total number of the parallel registers. That is, each shift register of the plurality of shift registers 321 can have a corresponding parallel register included in the plurality of parallel registers 322. For example, shift register 324-1 can correspond to parallel register 328-1.

Each of the plurality of shift registers and the plurality of parallel registers can include a plurality of timeslots. For example, shift register 324-1 can include timeslots 325-1, 325-2, 325-3, and 325-B. Similarly, parallel register 328-1 can include timeslots 329-1, 329-2, 329-3, 329-C, which can correspond to the timeslots 325-1, 325-2, 325-3, and 325-B, respectively. That is, timeslots in the shift registers can have corresponding timeslots in the parallel registers. For instance, a total number of the timeslots 329-1, . . . , 329-C in the shift registers 321 can be equal to a total number of the timeslots 325-1, . . . , 325-B in the parallel registers 322.

The timeslots of the shift registers can be assigned firing instructions (e.g., a 1 or a 0 that can be used to fire or not fire a nozzle). For example, shift register 324-1 can have firing instructions 330-1, 330-2, 330-3, and 330-Q assigned to timeslots 325-1, 325-2, 325-3, and 325-B, respectively. Similar firing instructions are assigned to shift registers 324-2, . . . , 324-S but have been purposely omitted from the figures for ease of illustration. Firing instructions can be assigned to the plurality of shift registers equally, as described herein. Firing instructions can be assigned to some of the timeslots of a shift register, as illustrated in FIG. 3, or all of the timeslots of the plurality of shift registers depending upon print data associated with a print job. Assignment of the firing instructions, as described herein, enables at least two nozzle data bits (e.g., firing instructions) to be assigned into the timeslots of shift registers in one firing sequence. For example, eight bits of nozzle data can be assigned to respective shift registers in one firing sequence.

Firing instructions assigned to the plurality of shift registers 321 can be copied to the plurality of parallel registers 322. For example, assigned firing instructions can be copied to parallel registers 322 in response to assignment of all of the firing instructions of a firing cycle (e.g., assignment of all firing instructions corresponding to a page of a print job) to the shift registers 321.

In some examples, assigned firing instructions can be copied to corresponding parallel registers as a parallel load. A parallel load refers to concurrently copying respective a firing instruction from each of the plurality of shift registers to corresponding parallel registers in parallel (e.g., not in series). For example, eight bits corresponding to eight firing instructions from eight respective timeslots included in a first set of firing instructions (e.g., a set of firing instructions 323-1) can be copied concurrently to corresponding parallel registers included in a subgroup (e.g., subgroup 326) of the plurality of parallel registers 322. In this manner, each set of firing instructions 323-1, 323-2, 323-3, . . . , 323-X can be copied sequentially to corresponding parallel registers, for example. The firing instructions can, in some examples, be copied to the parallel registers in response to each of a plurality firing instructions for a firing cycle being assigned to the shift registers.

The parallel registers 322 can have a plurality of primitives included in a primitive sequence 331 associated therewith. A primitive sequence refers to information (e.g., numerical sequence(s)) that identifies a respective firing order of each of a plurality of primitives. For example, a primitive sequence 331 can include a respective firing order of each of a plurality of primitives, as described herein, included in the primitive sequence 331.

A primitive sequence can identify an ascending, a descending, and/or a non-linear firing order of the primitives, among other possible firing orders of the primitives to promote sequencing printers. For example, a primitive sequence including a plurality of primitives 334-1, 334-2, 334-3, . . . , 334-R can be associated with the parallel registers 328-1, . . . , 328-P. For instance, the plurality of primitives 334-1, . . . , 334-R can be associated with respective subgroups 326-1, 326-2, 326-3, . . . , 326-K of the parallel registers 328-1, . . . , 328-P. As illustrated in FIG. 3, a respective subgroup (e.g., subgroup 326-1) of the plurality of parallel registers can be associated with a respective primitive (e.g., primitive 334-1) of the plurality of primitives 334-1, . . . , 334-R. In some examples, each nozzle on a respective primitive can be assigned a firing instruction for each firing sequence (e.g., each page of a print job).

A primitive sequence can be repeated across timeslots and/or vary across timeslots. A repeated primitive sequence can, for example, be represented by Rep(TS, Pseq), where Pseq is the primitive sequence and TS is a total number of timeslots. Repeating primitive sequences, compared to non-repeating primitive sequences, can enable a comparatively smaller amount of data to be sent to nozzles of a printer, among other advantages. However, the present disclosure is not so limited. That is, the primitive sequences can be non-repeating, varying, and/or a combination of repeating and vary across timeslots.

A length of a primitive sequence is equal to a total number of primitives included in a printhead and/or a total number of primitives associated with respective subgroups of parallel registers, as described herein. An ASIC such as those described herein, can, in some examples, employ a primitive select sequence. A primitive select sequence refers to an "inverse" or complement of a primitive sequence. It can be derived by subtracting a primitive sequence from N+1, where N is a total number of a plurality of primitives (e.g., those included in a printbar). For example, when N=4, a firing sequence including in a primitive sequence represented by {2, 4, 1, 3} will convert into {3, 1, 4, 2}. Use of a primitive select sequence, can be employed by an ASIC (e.g., a digital ASIC), to avoid potential complications with the ASIC using 0 as an index as may sometimes be employed by an ASIC. The conversion from primitive sequences to primitive select sequences can be performed, for example, by firmware (e.g., upon receipt off image data, print data, and/or prior to printing a print job).

A primitive can include between 32-112 nozzles per primitive. For example, a primitive can include 96 nozzles per primitive. Other primitives which may be limited to no more than 20 nozzles per primitive due to firing/timing constraints associated with due to sending print data (e.g., firing instructions) to each of the nozzles as a single sequence via a single network, in contrast to sequencing printers as described herein.

A firing order of the primitives and/or nozzles can be based upon a number of considerations including ensuring a desired amount of color separation between different colors of fluid, ensuring a desired amount of color separation within a particular color of fluid (e.g., separation between ejections of fluid of two or more nozzles printing the same color of fluid), among other considerations. In some examples, the firing order can include sending a number of zero(s) in firing instruction(s) to some nozzles of a printhead, for instance, to minimize cross-talk.

For example, a printer having a plurality of primitives, such as those described herein, with a firing order represented by P1, P2, P3, . . . , PN (e.g., a last and/or bottom primitive), can have an ascending firing order represented by {P1, P2, P3, . . . }, a descending firing order represented by {PN, P11, P10}, and/or a non-linear firing order represented by {P3, P5, P1, P7, . . . }, among other possible firing orders of the primitives. In a printbar, P1 can correspond to a top and/or first primitive of a pen column in the printbar, P2 can be the next comparatively lower (compared to P1) primitive of a plurality of primitives in the printbar, and PN can be a bottom (e.g., at an opposite end of the printbar from P1) and/or last primitive included in the printbar, among other possible arrangements.

In some examples, the shift registers 321 can be disposed in respective parallel rows on an outer surface of a rotatable cylinder (not shown). Such a cylinder can, for example, be rotatable to align a respective set of firing instructions included in each of the parallel rows on the outer surface of the rotatable cylinder with a corresponding subgroup of parallel registers. In this manner, the rotatable cylinder can function as the first network (e.g., promote assignment of firing instructions to shift registers and/or copying firing instructions to parallel registers, etc.). The rotation of the cylinder can be based upon timeslot data (e.g., data indicative of which timeslot in which shift register a firing instruction is assigned) associated with the firing instructions, among other information.

Figure 4:
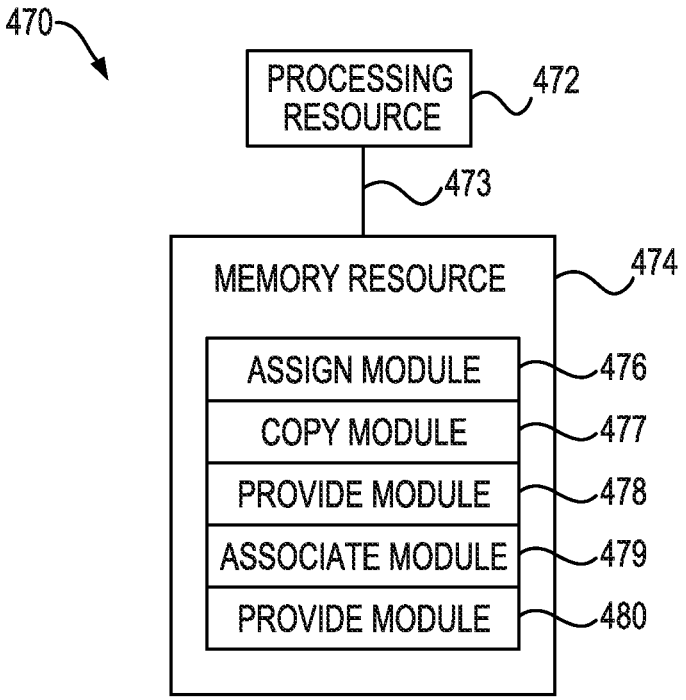
FIG. 4 illustrates a diagram of an example of a system for sequencing printers according to the present disclosure.

FIG. 4 illustrates a diagram of an example of a system 470 for sequencing printers according to the present disclosure. A system 470 can utilize software, hardware, firmware, and/or logic to perform a number of functions. The system 470 can be a combination of hardware and program instructions to sequence printers. The hardware, for example can include a processing resource 472, a memory resource 474 (e.g., computer-readable medium (CRM)). Processing resource 472, as used herein, can include a number of processing resources capable of executing instructions stored by a memory resource 474. Processing resource 472 may be integrated in a single device or distributed across devices. The program instructions (e.g., computer-readable instructions (CRI)) can include instructions stored on the memory resource 474 and executable by the processing resource 472 to implement a desired function (e.g., assign firing instructions included in an address sequence, via a first network, to shift registers of a printer, etc.).

The memory resource 474 can be in communication with a processing resource 472. A memory resource 474, as used herein, can include a number of memory components capable of storing instructions that can be executed by processing resource 472. Such memory resource 474 can be a non-transitory CRM. Memory resource 474 may be integrated in a single device or distributed across devices. Further, memory resource 474 may be fully or partially integrated in the same device as processing resource 472 or it may be separate but accessible to that device and processing resource 472. The system 470 may be implemented on a printhead and/or printer, as described herein.

The processing resource 472 can be in communication with a memory resource 474 storing a set of CRI executable by the processing resource 472, as described herein. The CRI can also be stored in remote memory managed by a server and represent an installation package that can be downloaded, installed, and executed.

Processing resource 472 can execute CRI that can be stored on an internal or external memory resource 474. The processing resource 472 can execute CRI to perform various functions, including the functions described herein. For example, the processing resource 472 can execute CRI to copy firing instructions, assigned to a plurality of shift registers of a printer via a first network, to a plurality of parallel registers that correspond to the plurality of shift registers.

The CRI can include a number of modules such as an assign module 476, a copy module 477, a provide module 478, an associate module 479, and a provide module 480. The number of modules can include CRI that when executed by the processing resource 472 can perform a number of functions. The number of modules can be sub-modules of other modules. For example, an assign module 476 and a copy module 477 can be sub-modules and/or contained within the same computing device. Similarly, a provide module 478 and a provide module 480 can sub-modules and/or contained within the same computing device. In another example, the number of modules 476, 477, 478, 479, 480 can include individual modules at separate and distinct locations (e.g., CRM, etc.).

In various examples, the system can include an assign module 476. An assign module 476 can include CRI that when executed by the processing resource 472 can assign a first set of firing instructions included in an address sequence, via a first network, equally to each shift register of a plurality of shift registers of a printer. Assigning equally refers to assigning a respective firing instructions to each shift register of the plurality of shift registers and/or assigning firing instructions such that each shift register can have an equal number of firing instructions assigned thereto (e.g., 4 firing instructions assigned to each of shift register).

Such assignment can be based on timeslot data associated with the firing instructions. A timeslot sequence (e.g., a plurality of timeslot data) can be associated with an address sequence, for instance, such that each firing instruction in the address sequence is associated with a respective portion of the timeslot data included in the timeslot sequence. For instance, each firing instruction can have corresponding timeslot data associated therewith that can determine which shift register of the plurality of shift registers a particular firing instruction is assigned to. Advantageously, assignment based on timeslot data can promote non-linear assignment of firing instructions to the plurality of shift registers. For example, a firing instruction having a timeslot (e.g., timeslot 3) can be assigned to a shift register (e.g., shift register 3) and another firing instruction having another timeslot (e.g., timeslot 0) can be assigned to another shift register (e.g., shift register 0). In some examples, the assign module 476 can assign another set of firing instructions, via a first network, to a plurality of shift registers, in response to copying the first set of firing instructions, for example as described with respect to copy module 477, to the plurality of parallel registers.

A copy module 477 can include CRI that when executed by the processing resource 472 can perform a number of copying functions. A copy module 477 can copy firing instructions, assigned to a plurality of shift registers of a printer via a first network, to a plurality of parallel registers that correspond to the plurality of shift registers. For example, copy module 477 can copy each of the assigned firing instructions (e.g., assigned firing instruction included in the first set of firing instructions) to a plurality of parallel registers. Each shift register of the plurality of shift registers can have a corresponding parallel register of the plurality of parallel registers to promote copying by the copy module 477.

A provide module 478 can include CRI that when executed by the processing resource 472 can perform a number of providing functions. The provide module 478 can include instructions to provide, via a second network, the primitive sequence to the parallel registers. The instructions described herein with respect to the number of modules can, for example, be stored in an internal or external non-transitory CRM coupled to the printing device (e.g., the printer 143 as illustrated in FIG. 1) that can execute instructions stored in the internal or non-transitory external CRM. For example, the provide module 478 can provide a primitive sequence including a firing order of each of a plurality of primitives to the parallel registers. In some examples, the provide module 478 can provide a primitive sequence to the parallel registers in response to copying each of the firing instructions assigned to the shift registers to the parallel registers. This can promote copying, providing, etc. of consecutive sets of address sequences including firing instructions and/or primitive sequences to print a print job, among other advantages.

A select module (not shown) can select a primitive sequence including a respective firing order of each of a plurality of primitives included in the primitive sequence. Such a primitive sequence (e.g., a primitive sequence including a firing order of each of a plurality of primitives) can be provided, by a provide module 478, via a second network, to parallel registers.

The system can include an associate module 479. An associate module 479 can include CRI that when executed by the processing resource 472 can provide a number of associating functions. The associate module 479 can associate each of the plurality of primitives with respective subgroups of the plurality of parallel registers. For example, the associate module 479 can associate the plurality of primitives with respective subgroups of the plurality of parallel registers such that a firing instruction of each of the parallel registers can be associated with a primitive of the plurality of primitives.

A select module (not shown) can select, a firing instruction, of a parallel register included in a subgroup of the parallel registers associated with a first primitive in the primitive sequence to be printed. For example, the select module can select firing instructions of a respective subgroup associated with a first primitive in the primitive sequence to be printed (e.g., provided to a printer by the provide module 480). The select module can, in some examples, select firing instructions of a respective subgroup associated with a second primitive in the primitive sequence in response to each of the selected firing instructions of the first primitive being provided to a printer (e.g., by the provide module 480).

A provide module 480 can include CRI that when executed by the processing resource 472 can perform a number of providing functions. A provide module 480 can provide a plurality of firing instructions of a respective subgroup of the parallel registers associated with a first primitive in the primitive sequence to a plurality of nozzles to be printed. A total number of a plurality of nozzles included in each of the plurality of primitives can be the same (e.g., each primitive can include 32 nozzles).

In some example, the provide module 480 can send firing instructions to the nozzles as a sequence of firing data sent to at least two of the nozzles concurrently. For instance, firing instructions included in a subgroup of parallel registers can be provided concurrently to the nozzles (e.g., to 8 nozzles concurrently). The nozzles can be fired based on the firing instructions provided by the provide module 480.

The memory resource 474 can be integral, or communicatively coupled, to a computing device, in a wired and/or a wireless manner. For example, the memory resource 474 can be an internal memory, a portable memory, a portable disk, or a memory associated with another computing resource (e.g., enabling CRIs to be transferred and/or executed across a network such as the Internet).

The memory resource 474 can be in communication with the processing resource 472 via a communication path 473. The communication path 473 can be local or remote to a computing device) associated with the processing resource 472. Examples of a local communication path 473 can include an electronic bus internal to a computing device where the memory resource 474 is one of volatile, non-volatile, fixed, and/or removable storage medium in communication with the processing resource 472 via the electronic bus.

The communication path 473 can be such that the memory resource 474 is remote from the processing resource (e.g., 472), such as in a network connection between the memory resource 474 and the processing resource (e.g., 472). That is, the communication path 473 can be a network connection. Examples of such a network connection can include a local area network (LAN), wide area network (WAN), personal area network (PAN), and the Internet, among others. In such examples, the memory resource 474 can be associated with a first computing device and the processing resource 472 can be associated with a second computing device (e.g., a Javeserver). For example, a processing resource 472 can be in communication with a memory resource 474, where the memory resource 474 includes a set of instructions and where the processing resource 472 is designed to carry out the set of instructions.

Figure 5:
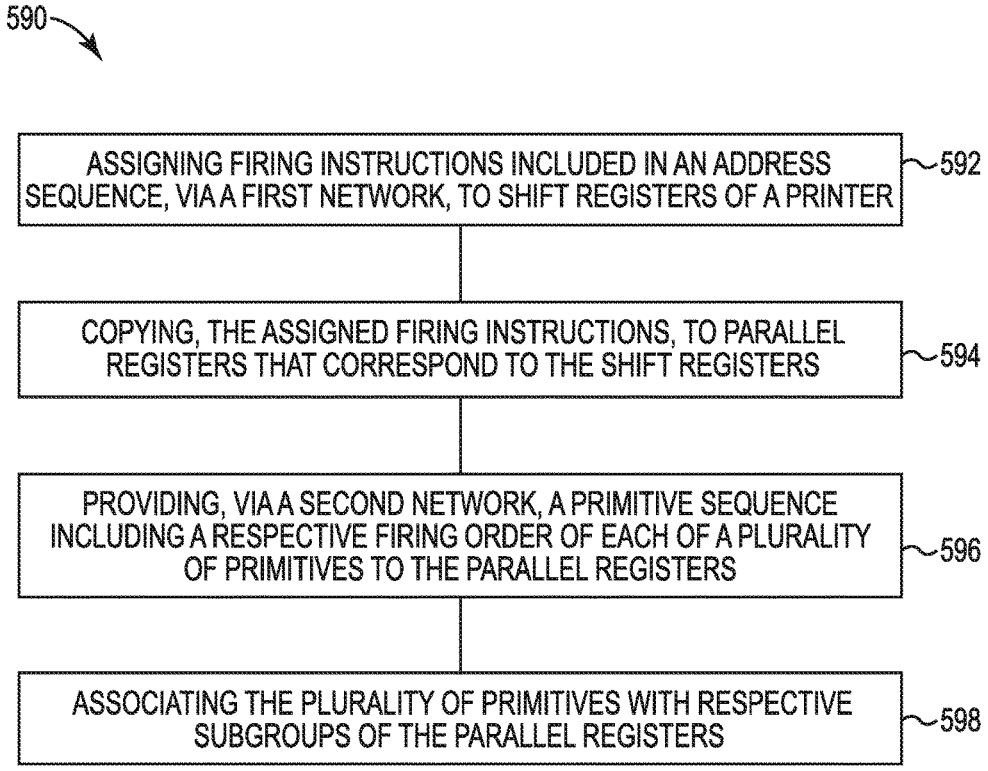
FIG. 5 is an example of a method for sequencing printers according to the present disclosure.

FIG. 5 is an example of a method for sequencing printers according to the present disclosure. As shown at 592, the method 590 can include assigning firing instructions included in an address sequence, via a first network, to shift registers of a printer. Firing instructions can be assigned based on content of a print job sent to a printer. For example, content included in a print job, such as content included in each of a number of pages included in the print job can be analyzed prior to printing the print job. Such analyzing can include analyzing page dot density (e.g., a dot distribution map) of the print job, among other data included in a print job. The print job can be analyzed while in a printing queue, for example, in a printing queue including a number of print jobs to be printed and/or can be analyzed during spooling of the print job, among other suitable times before printing. In some examples, the firing instructions can be assigned equally, as described herein, to the shift registers.

The method 590 can include, copying, the assigned firing instructions, to parallel registers that correspond to the shift registers, as shown at 594. The assigned firing instructions can be copied from the shift registers to the parallel registers via a suitable interconnection (e.g., network) between the first network and the second network. In some examples, assigned firing instructions, such as those assigned at 592, can be copied to the corresponding parallel registers as a parallel load, as described herein.

As shown at 596, the method 590 can include providing, via a second network, a primitive sequence including a respective firing order of each of a plurality of primitives to the parallel registers. The method 590 can include associating the plurality of primitives with respective subgroups of the parallel registers, as illustrated at 598. The method 590 including 592, 594, 596, 598 can include executing instructions, for example, as described with regard to the processing resource(s) herein, stored in memory resource(s) to perform the examples of the method described therein.

The figures herein follow a numbering convention in which the first digit or digits correspond to the drawing figure number and the remaining digits identify an element or component in the drawing. As will be appreciated, elements shown in the various examples herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, "a number of" an element and/or feature can refer to one or more of such elements and/or features. In addition, "for example" and similar phrasing is intended to mean, "by way of example and not by way of limitation".

The specification examples provide a description of the applications and use of the system and method of the present disclosure. Since many examples can be made without departing from the spirit and scope of the system and method of the present disclosure, this specification sets forth some of the many possible example configurations and implementations.

What is claimed:

1. A printbar comprising:
a printhead; and
a controller to control the printhead having a plurality of nozzles, the controller to:
copy firing instructions assigned over a first network to a plurality of shift registers, to a plurality of parallel registers that correspond to the plurality of shift registers;
select a primitive sequence including a respective firing order of a plurality of primitives included in the primitive sequence;
provide the primitive sequence, over a second network, to the parallel registers;
associate the plurality of primitives with respective subgroups of the plurality of parallel registers, wherein a firing instruction of each of the parallel registers is associated with a primitive of the plurality of primitives; and
select a firing instruction of a parallel register included in a subgroup of the parallel registers associated with a first primitive in the primitive sequence to be printed.

2. The printbar of claim 1, comprising a plurality of printhead dies that extend along a width of a print medium to dispense fluid onto the print medium.

3. The printbar of claim 2, wherein the printbar spans a width of the print medium.

4. The printbar of claim 1, wherein the printhead comprises a printhead die.

5. The printbar of claim 1, wherein the controller is included in the printhead.

6. The printbar of claim 5, wherein the controller is implemented in a circuit layer of the printhead.

7. The printbar of claim 1, wherein the controller is to assign another set of firing instructions over the first network to the plurality of shift registers, in response to the copying of the firing instructions to the plurality of parallel registers.

8. The printbar of claim 1, wherein the controller is to provide the primitive sequence to the parallel registers in response to copying the firing instructions assigned to the shift registers to the parallel registers.

9. The printbar of claim 1, wherein a primitive of the plurality of primitives includes a set of addresses designating respective nozzles of the printhead.

10. The printbar of claim 9, wherein each nozzle of a respective primitive is assigned a firing instruction for each firing sequence.

11. The printbar of claim 1, wherein the copying of the firing instructions from the plurality of shift registers to the plurality of parallel registers is performed as part of a parallel load to the plurality of parallel registers.

12. A printhead comprising:
nozzles to dispense fluid; and
a controller to:
assign firing instructions included in an address sequence, over a first network, to a plurality of shift registers;
copy the assigned firing instructions to a plurality of parallel registers, wherein each shift register of the plurality of shift registers has a corresponding parallel register of the plurality of parallel registers;
provide, over a second network, a primitive sequence including a firing order of a plurality of primitives to the parallel registers;
associate the plurality of primitives with respective subgroups of the plurality of parallel registers;
provide a plurality of firing instructions of a respective subgroup of the parallel registers associated with a first primitive in the primitive sequence to the nozzles to be printed.

13. The printhead of claim 12, wherein the first network and the second network are separate and distinct.

14. The printhead of claim 12, wherein the plurality of shift registers are disposed in respective parallel rows on an outer surface of a rotatable cylinder.

15. The printhead of claim 12, wherein a nozzle is fired based on a firing instruction of the plurality of firing instructions provided to the parallel registers.

16. The printhead of claim 12, wherein the controller is to assign the firing instructions to the plurality of shift registers based on timeslot data associated with the firing instructions, where each shift register of the plurality of shift registers includes a plurality of timeslots.

17. A method of operating a printbar, comprising:
assigning, by a controller of the printbar, firing instructions included in an address sequence, over a first network, to shift registers;

copying, by the controller, the assigned firing instructions to parallel registers that correspond to the shift registers;

providing, over a second network, a primitive sequence including a respective firing order of a plurality of primitives to the parallel registers; and associating the plurality of primitives with respective subgroups of the parallel registers.

18. The method of claim 17, further comprising selecting, by the controller, firing instructions of a respective subgroup associated with a first primitive in the primitive sequence to be printed.

19. The method of claim 18, further comprising selecting firing instructions of a respective subgroup associated with a second primitive in the primitive sequence in response to each of the selected firing instructions of the first primitive being provided to a printer.

20. The method of claim 17, wherein the assigned firing instructions are copied to the corresponding parallel registers as a parallel load.

* * * * *